United States Patent [19]

Daubendiek et al.

[11] Patent Number: 4,639,411

[45] Date of Patent: Jan. 27, 1987

[54] RADIOGRAPHIC ELEMENTS EXHIBING REDUCED CROSSOVER

[75] Inventors: Richard L. Daubendiek; Robert E. Dickerson, both of Rochester; James E. Kelly, Pittsford, all of N.Y.

[73] Assignee: Eastman Kodak Company, Rochester, N.Y.

[21] Appl. No.: 839,014

[22] Filed: Mar. 11, 1986

[51] Int. Cl.[4] ..... G03C 1/84

[52] U.S. Cl. ..... 430/510; 430/567; 430/569; 430/966

[58] Field of Search ..... 430/510, 966, 967, 567, 430/569

[56] References Cited

U.S. PATENT DOCUMENTS

| | | | |
|---|---|---|---|
| 2,327,764 | 8/1943 | Carroll | 430/567 |
| 3,923,515 | 12/1975 | VanStappen | 250/323 |
| 4,094,684 | 6/1978 | Maskasky | 430/567 |
| 4,142,900 | 3/1979 | Maskasky | 430/567 |
| 4,158,565 | 6/1979 | Maskasky | 430/567 |
| 4,459,353 | 7/1984 | Maskasky | 430/567 |
| 4,490,458 | 12/1984 | House | 430/567 |

FOREIGN PATENT DOCUMENTS

| | | |
|---|---|---|
| 505012 | 8/1930 | Fed. Rep. of Germany . |
| 2063499A | 2/1981 | United Kingdom . |

OTHER PUBLICATIONS

*Research Disclosure,* Item 18431 (Section V), vol. 184, Aug. 1979.

Byerley & Hirsch, "Dispersions of Metastable High Temperature Cubic Silver Iodide", *Journal of Photographic Science,* vol. 18, 1970, pp. 53–59.

Daubendiek, U.S. Ser. No. 784,139 filed Oct. 4, 1985, commonly assigned, titled Elemets Containing Bright Yellow Silver Iodide.

Zharkov, Dobroserdova, & Panfilova, "Crystallization of Silver Halides in Photographic Emulsions IV, Study by Electroscopy of Silver Iodide Emulsions", *Zh. Nauch. Prikl. Fot. Kine,* Mar.–Apr., 1957, 2, pp. 102–105.

Ozaki & Hachisu, "Photophoresis and Photo-Agglomeration of Plate-like Silver Iodide Particles", *Science of Light,* vol. 19, No. 2, 1970, pp. 59–71.

James, *The Theory of The Photographic Process,* 4th Ed., Macmillan, 1977, pp. 1 and 2.

Maskasky, Research Disclosure, Item 16158, vol. 161, pp. 84–87, Sep., 1977.

Daubendiek, "AgI Precipitations: Effects of pAg on Crystal Growth (PB)", II-23, *Papers from the 1978 International Congress of Photographic Science,* Rochester, N.Y., pp. 140–143, 1978.

Maskasky, *Research Disclosure,* vol. 181, May 1979, Item 18153.

*Primary Examiner*—Jack P. Brammer

*Attorney, Agent, or Firm*—Carl O. Thomas

[57] ABSTRACT

A radiographic element is disclosed having a support capable of transmitting blue light and, coated on each of two opposite major faces of said support, a silver halide emulsion layer capable of forming a latent image in response to exposure to blue light. Interposed between at least one of the latent image forming emulsion layers and the support is a blue absorbing silver iodide emulsion layer exhibiting at temperatures below 25° C. an absorption transition wavelength that is bathochromically displaced by at least 20 nm as compared to the absorption transition wavelength of $\beta$ phase silver iodide.

8 Claims, 1 Drawing Figure

RADIOGRAPHIC ELEMENTS EXHIBING REDUCED CROSSOVER

FIELD OF THE INVENTION

The invention relates to dual coated silver halide radiographic elements.

BACKGROUND OF THE INVENTION

Emulsions comprised of a dispersing medium and silver halide microcrystals or grains have found extensive use in photography. Radiation sensitive silver halide emulsions have been employed for latent image formation. The radiation sensitive silver halide grains employed in photographic emulsions are typically comprised of silver chloride, silver bromide, or silver in combination with both chloride and bromide ions, each often incorporating minor amounts of iodide. Radiation sensitive silver iodide emulsions, though infrequently employed in photography, are known in the art. Silver halide emulsions are known to be useful in photographic elements for purposes other than latent image formation, such as for radiation absorption or scattering, interimage effects, and development effects.

In general silver halides exhibit limited absorption within the visible spectrum. Progressively greater blue light absorptions are observed in silver chloride, silver bromide, and silver iodide. However, even silver iodide emulsions appear pale yellow, with their principal light absorption occurring near 400 nm.

The crystal structure of silver iodide has been studied by crystallographers, particularly by those interested in photography. The most commonly encountered crystalline class of silver iodide is the hexagonal wurtzite class, hereinafter designated $\beta$ phase silver iodide. Silver iodide of the face centered cubic crystalline class, hereinafter designated $\gamma$ phase silver iodide, is also stable at room temperature. The $\beta$ phase of silver iodide is the more stable of the two phases so that emulsions containing $\gamma$ phase silver iodide grains also contain at least a minor proportion of $\beta$ phase silver iodide grains.

Byerley and Hirsch, "Dispersions of Metastable High Temperature Cubic Silver Iodide", *Journal of Photographic Science,* Vol. 18, 1970, pp. 53–59, have reported emulsions containing a third crystalline class of silver iodide, the body centered cubic class, hereinafter designated $\alpha$ phase silver iodide. $\alpha$ phase silver iodide is bright yellow, indicating that it exhibits increased absorption in the blue portion of the spectrum as compared to $\beta$ and $\gamma$ phase silver iodide, which are cream colored. The emulsions containing $\alpha$ phase silver iodide studied by Byerley and Hirsch were unstable in that they entirely reverted to cream colored silver iodide at temperatures below 27° C.

Daubendiek U.S. Ser. No. 784,139, filed Oct. 4, 1985, commonly assigned, titled ELEMENTS CONTAINING BRIGHT YELLOW SILVER IODIDE discloses silver iodide emulsions exhibiting at temperatures below 25° C. an absorption transition wavelength that is bathochromically displaced by at least 20 nm as compared to the absorption transition wavelength of $\beta$ phase silver iodide. The emulsions are disclosed to be useful for absorbing blue light.

In silver halide photography one or more silver halide emulsion layers are usually coated on a single side of a support. An important exception is in medical radiography. To minimize patient X ray exposure silver halide emulsion layers are commonly dual coated (that is, coated on both opposed major faces) of a film support. Since silver halide emulsion layers are relatively inefficient absorbers of X radiation, the radiographic element is positioned between intensifying screens that absorb X radiation and emit light. Crossover exposure, which results in a reduction in image sharpness, occurs when light emitted by one screen passes through the adjacent emulsion layer and the support to imagewise expose the emulsion layer on the opposite side of the support. Loss of image sharpness results from light spreading in passing through the support.

It is quite common in radiography to use blue emitting intensifying screens. At the same time radiographic supports used with these screens are typically clear or blue tinted; hence, in each instance transparent to blue light.

A variety of approaches have been suggested to the art to reduce crossover, as illustrated by *Research Disclosure,* Vol. 184, August 1979, Item 18431, Section V. *Research Disclosure* is published by Kenneth Mason Publications, Etd., Emsworth, Hampshire P010 7DD, England. More particularly it has been taught to coat a relatively lower speed silver halide emulsion between the support and a higher speed silver halide emulsion layer to reduce crossover, as illustrated by Van Stappen U.S. Pat. No. 3,923,515.

While the art cited above is considered most pertinent to the invention claimed, additional art which may be of background interest is identified and discussed in the Related Art Appendix following the Examples.

SUMMARY OF THE INVENTION

In one aspect this invention is directed to a radiographic element comprised of a support capable of transmitting blue light and, coated on each of two opposite major faces of said support, a silver halide emulsion layer capable of forming a latent image in response to exposure to blue light transmitted through the support. Interposed between at least one of the latent image forming emulsion layers and the support is a blue absorbing layer. The radiographic element is further characterized in that the blue absorbing interposed layer is a silver iodide emulsion layer exhibiting at temperatures below 25° C. an absorption transition wavelength that is bathochromically displaced by at least 20 nm as compared to the absorption transition wavelength of $\beta$ phase silver iodide.

BRIEF SUMMARY OF THE DRAWINGS

The invention can be better appreciated by reference to the following detailed description considered in conjunction with the drawings, in which.

DESCRIPTION OF PREFERRED EMBODIMENTS

Figure 1:
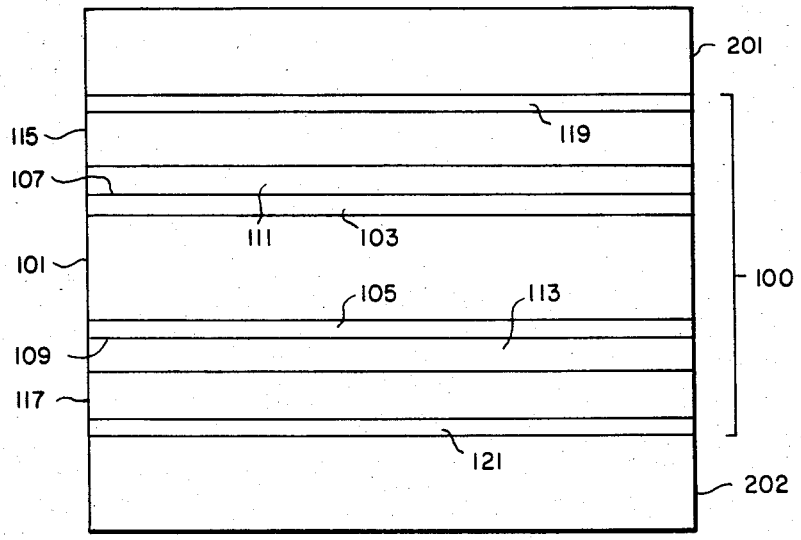
FIG. 1 is a schematic diagram of an assembly of a radiographic element according to the invention in combination with a pair of intensifying screens.

Referring to FIG. 1, in the assembly shown a radiographic element 100 according to this invention is positioned between a pair of blue emitting intensifying screens 201 and 202. The radiographic element support is comprised of a radiographic support element 101, typically transparent or blue tinted, capable of transmitting at least a portion of the blue light to which it is exposed and optional, similarly transmissive subbing layer units 103 and 105, each of which can be formed of one or more adhesion promoting layers. On the first and second opposed faces 107 and 109 of the support formed by the subbing layer units are blue absorbing layers 111 and 113, respectively. Overlying the blue absorbing layers 111 and 113 are blue recording latent image forming silver halide emulsion layer units 115 and 117, respectively. Each of the emulsion layer units can be formed of one or more silver halide emulsion layers. Overlying the emulsion layer units 115 and 117 are optional protective overcoat layers 119 and 121, respectively.

In use, the assembly is imagewise exposed to X radiation. The X radiation is principally absorbed by the intensifying screens 201 and 202, which promptly emit blue light as a direct function of X ray exposure. Considering first the blue light emitted by screen 201, the blue recording latent image forming emulsion layer unit 115 is positioned adjacent this screen to receive the blue light which it emits. Because of the proximity of the screen 201 to the emulsion layer unit 115 only minimal light scattering occurs before latent image forming absorption occurs in this layer unit. Hence blue light emission from screen 201 forms a sharp image in emulsion layer unit 115.

However, not all of the blue light emitted by screen 201 is absorbed within emulsion layer unit 115. This remaining blue light, unless otherwise absorbed, will reach the remote emulsion layer unit 117, resulting in a highly unsharp image being formed in this remote emulsion layer unit. Both blue absorbing layers 111 and 113 are interposed between the screen 201 and the remote emulsion layer unit and are capable of intercepting and attenuating this remaining blue light. Both blue absorbing layers thereby contribute to reducing crossover exposure of emulsion layer unit 117 by the screen 201.

In an exactly analogous manner the screen 202 produces a sharp image in emulsion layer unit 117, and the blue absorbing layers 111 and 113 similarly reduce crossover exposure of the emulsion layer unit 115 by the screen 202. It is apparent that either of the two blue absorbing layers employed alone can effectively reduce crossover exposures from both screens. Thus, only one blue absorbing layer is required, although for manufacturing convenience dual coated radiographic elements most commonly employ identical coatings on opposite major faces of the support.

The radiographic elements of the present invention offer advantages in crossover reduction by employing one or more blue absorbing layers comprised of a silver iodide emulsion that is highly efficient in absorbing blue light at ambient temperatures—e.g., at temperatures of less than 25° C. By a unique preparation procedure set forth below in the Examples it has been possible to prepare a silver iodide emulsion not heretofore known in the art that is bright yellow at ambient temperatures.

The bright yellow color of the silver iodide emulsion is an important quality, since it is visible proof that a higher proportion of blue light is being absorbed at ambient temperatures than is absorbed at these temperatures by conventional silver iodide emulsions. Silver iodide emulsions heretofore observed at ambient temperatures have appeared pale yellow.

The blue light absorption advantage of the bright yellow silver iodide emulsions can be quantitatively expressed by observing that the absorption transition wavelength in the blue spectrum is bathochromically displaced more than 20 nm as compared to the blue spectrum absorption transition wavelength of a corresponding silver iodide emulsion in which the silver iodide consists essentially of $\beta$ phase silver iodide. The "blue spectrum" is the portion of the visible electromagnetic spectrum extending from 400 to 500 nm. The "transition wavelength" is defined as the longest blue spectrum absorption wavelength that separates a hypsochromic 20 nm spectral interval and a 20 nm bathochromic spectral interval differing in that absorption variance is at least 5 times greater in the hypsochromic spectral interval than in the bathochromic spectral interval.

Silver iodide emulsions all show a relatively high absorption at 400 nm and a relatively low absorption at 500 nm. A steep transition in absorption occurs within the blue spectrum. For silver iodide of differing crystal classes the rise from low to high absorptions occurs at differing blue wavelengths. The transition wavelength identifies the onset or toe of the absorption rise in traversing the blue spectrum from longer to shorter wavelengths. As an illustration, in the examples below the silver iodide emulsion satisfying the requirements of this invention exhibits an absorption variance of about 1% between 520 and 490 nm and an absorption variance of about 20% between 490 and 470 nm. For this emulsion coating the transition wavelength is 490 nm. The transition wavelength for a corresponding emulsion consisting essentially of $\beta$ phase silver iodide grains is 455 nm, since the bathochromic 20 nm interval exhibits an absorption variance of about 1% while the hypsochromic 20 nm interval exhibits an absorption variance of 14%. In this comparison there is a 35 nm difference in the transition wavelengths of the two silver iodide emulsion coatings.

The transition wavelength of the emulsions employed in the practice of this invention is referenced to the transition wavelength of emulsions consisting essentially of $\beta$ phase silver iodide grains, since this is the most readily prepared and most stable form of silver iodide. Emulsions which contain $\gamma$ phase silver iodide also contain $\beta$ phase silver iodide in varying proportions. It is recognized that the presence of $\gamma$ phase silver iodide shifts the transition wavelength bathochromically to some extent as compared to the transition wavelength of emulsions consisting of $\beta$ phase silver iodide. However, the presence of $\gamma$ phase silver iodide can not alone account for a 20 nm bathochromic displacement of the transition wavelength as compared to $\beta$ phase silver iodide.

When the transition wavelength of emulsions employed in the practice of this invention is at least 20 nm greater than the transition wavelength of emulsions consisting essentially of $\beta$ phase silver iodide grains, the transition wavelength occurs at a longer wavelength than any heretofore known silver iodide emulsion which is stable at ambient temperatures. In preferred embodiments of the invention the emulsions employed are silver iodide emulsions exhibiting a transition wavelength which is at least 30 nm bathochromically displaced as compared to the transition wavelength of silver iodide consisting essentially of $\beta$ phase silver iodide.

It is to be noted that the transition wavelength of silver iodide emulsions varies as a function of average grain size and silver coating coverage. Thus, in comparing emulsions containing silver iodide grains of differing crystallographic classes corresponding average grain sizes and silver coating coverages are necessary. When emulsions of varied grain sizes and silver coating coverages differing only in the crystallographic class of the silver iodide are compared, the differences in their transition wavelengths are remarkably constant.

The silver iodide emulsions employed in the practice of this invention contain silver iodide grains—that is, grains which have an identifiable discrete silver iodide phase. Attempts to identify the crystallographic class of the silver iodide have been unsuccessful, except to the extent that it has been determined that neither $\alpha$ phase, $\beta$ phase, $\gamma$ phase silver iodide, nor mixtures of these silver iodide phases can account for all the observed properties of the silver iodide emulsions prepared and employed. That is, at least a significant portion of the silver iodide exhibits properties differing from the three known phases of silver iodide. It is, of course, recognized that silver iodide emulsions prepared as described below can be blended with conventional silver iodide emulsions and still satisfy the requirements of this invention, provided transition wavelength requirements of this invention are preserved.

The bright yellow silver iodide grain population of the emulsions are prepared using the general double jet precipitation techniques known to the photographic art, as illustrated by *Research Disclosure,* Vol. 176, December 1978, Item 17643, Paragraph I, modified as illustrated by the Examples.

The bright yellow silver iodide grains can be of any convenient size for the application undertaken. Since any ripening out of silver iodide grains which occurs after their initial formation has the effect of increasing the proportion of $\beta$ or $\gamma$ phase silver iodide, it is preferred to prepare silver iodide grain populations under conditions that are not highly favorable to post precipitation ripening. For examle, it is generally most convenient for the silver iodide grains to have an average diameter of greater than 0.05 $\mu$m. Also, it is preferred to prepare the emulsions with a minimum of grain heterodispersity. Monodispered silver iodide grain populations are preferred. In quantitative terms, it is preferred that the bright yellow silver iodide grains exhibit a coefficient of variation of less than about 40 and optimally less than 20 percent, based on grain volume.

In addition to their increased levels of blue absorption the silver iodide emulsions described above are advantageous in that the silver iodide grains can be readily removed (i.e., fixed out) in processing concurrently with the undeveloped silver halide grains in the latent image forming silver halide emulsion layers. This avoids any variance from conventional processing and avoids any residual yellowing of the image bearing radiographic element, such as can be the case with incompletely removed yellow dyes, pigments, and the like heretofore conventionally employed for crossover reduction.

While the silver iodide emulsions heretofore described are preferably employed alone for crossover reduction, it is recognized that they can be employed in combination with conventional approaches for crossover reduction, if desired. A variety of approaches have been suggested to the art to reduce crossover, as illustrated by *Research Disclosure,* Vol. 184, August 1979, Item 18431, Section V, cited above and here incorporated by reference.

Apart from the blue absorbing layers 111 and 113 described above, the remaining features of the dual coated radiographic elements can take any convenient conventional form. Such conventional radiographic element features are illustrated, for example, in *Research Disclosure,* Item 18431, cited above and here incorporated by reference. Other conventional features common to both silver halide radiographic elements and photographic elements are disclosed in *Research Disclosure,* Vol. 176, December 1978, Item 17643.

Radiographic elements according to this invention having highly desirable imaging characteristics are those which employ one or more tabular grain silver halide emulsions. It is specifically contemplated to provide dual coated radiographic elements according to this invention in which tabular grain silver halide emulsion layers are coated nearer the support than nontabular grain silver halide emulsion layers to reduce crossover, as illustrated by Sugimoto European Patent Application No. 0,084,637.

Preferred radiographic elements according to the present invention are those which employ one or more high aspect ratio tabular grain emulsions or thin, intermediate aspect ratio tabular grain emulsions, as disclosed by Abbott et al U.S. Pat. Nos. 4,425,425 and 4,425,426, respectively. Preferred tabular grain emulsions for use in the radiographic elements of this invention are those in which tabular silver halide grains having a thickness of less than 0.5 $\mu$m (preferably less than 0.3 $\mu$m and optimally less than 0.2 $\mu$m) have an average aspect ratio of greater than 5:1 (preferably greater than 8:1 and optimally at least 12:1) and account for greater than 50 percent (preferably greater than 70 percent and optimally greater than 90 percent) of the total projected area of the silver halide grains present in the emulsion.

To maximize blue light absorption it is preferred to employ a blue spectral sensitizing dye adsorbed to the surface of the tabular silver halide grains. Preferred blue spectral sensitizing dyes as well as optimum chemical and spectral sensitizations of tabular silver halide grains are disclosed by Kofron et al U.S. Pat. No. 4,439,520, here incorporated by reference. Additional preferred sensitizations, including blue spectral sensitizations, for tabular grain silver halide imaging emulsions are disclosed by Maskasky U.S. Pat. No. 4,435,501.

The preferred radiographic elements of this invention are those which employ one or more of the crossover reducing blue absorbing layers described above in combination with tabular grain latent image forming emulsion containing conventional radiographic elements of the type disclosed in Abbott et al U.S. Pat. Nos. 4,425,425 and 4,425,426 and Dickerson U.S. Pat. No. 4,414,304, here incorporated by reference. By employing tabular grain emulsions, which in themselves reduce crossover in combination with the blue absorbing layers provided by this invention radiographic elements exhibiting extremely low crossover levels can be achieved while also achieving high photographic speed, ow levels of granularity, high silver covering power, and rapid processing capabilities deemed highly desirable in radiography.

EXAMPLES

The invention is further illustrated by the following examples. In each of the examples the contents of the reaction vessel were stirred vigorously throughout silver and iodide salt introductions; the term "percent" means percent by weight, unless otherwise indicated; and the term "M" stands for a molar concentration, unless otherwise stated. All solutions, unless otherwise stated, are aqueous solutions.

Example 1—Cross Results

Example 1A—Bright Yellow AgI Emulsion

A reaction vessel equipped with a stirrer was charged with 2.5 L of water containing 35 g of deionized bone gelatin. At 35° C. the pH was adjusted to 5.0 with $H_2SO_4$, and the pAg to 3.5 with $AgNO_3$. At 35° C. a 1.25M solution of $AgNO_3$ was added at a constant rate over 6 min, consuming 0.0038 mole Ag. The flow of $AgNO_3$ was then accelerated following the profile approximated by the equation flow rate=Initial Rate+$0.023t+0.00134t^2$ (t=time of acceleration in min) over a period of 44 min, consuming 0.089 mole Ag. Flow was continued at a constant rate over a period of 70 min, consuming 0.312 mole Ag. This was followed by acceleration on the same profile as previously over 26 min, consuming 0.176 mole Ag. Finally a constant flow over 45 min consumed 0.424 mole Ag. A total of 1.0 mole Ag was consumed in the precipitation. Concurrently with the $AgNO_3$ a 1.25M solution of NaI was added as required to maintain the pAg at 3.5. The pAg was adjusted to 10.15 at 35° C. with NaI and the pH to 4.00 with $H_2So_4$. A 1 L portion of the emulsion was washed by the procedure of Yutzy et al, U.S. Pat. No. 2,614,929. The final gelatin content was about 44 g/Ag mole.

X-ray powder diffraction analysis showed some of characteristics to match those of $\alpha$ phase silver iodide, but significant differences from $\alpha$ phase, $\beta$ phase, and $\gamma$ phase silver iodide prevented positive assignment of any art recognized silver iodide crystalline class. Unlike $\alpha$ phase and $\gamma$ phase silver iodide emulsions, which are pale yellow, this emulsion was bright yellow at room temperature. The grains exhibited an average equivalent circular diameter of 0.09 $\mu$m and a coefficient of variation of 25 percent, based on volumn.

Example 1B—Coating of the Invention (Lower Level of AgI)

On each side of a transparent blue tinted polyester support was coated an undercoat layer containing 1.08 g/m$^2$ gelatin and the bright yellow AgI emulsion of Example 1A at 0.135 g/m$^2$ Ag per side. Over this layer was coated on each side a sulfur and gold sensitized silver bromoiodide emulsion of mean grain size 0.79 $\mu$m, 3.4 mole% iodide, at 2.15 g/m$^2$ Ag and 1.51 g/m$^2$ gelatin per side. Over the emulsion was coated a protective overcoat at 0.86 g/m$^2$ gelatin per side.

Crossover was determined using the method described in Abbott et al, U.S. Pat. No. 4,425,425. Two types of screen were used: KODAK X-OMATIC® Regular Intensifying Screens, emitting in the UV at 360–420 nm, and KODAK X-OMATIC® Rapid Intensifying Screens, emitting in the UV at 360–400 nm, and in the blue at 460–510 nm. The film samples were processed in a KODAK RP X-OMAT® Processor, Model M6-N, using KODAK RP X-OMAT® Developer Starter and Developer Replenisher. The crossover results are shown in Table I.

Example 1C—Coating of the Invention (Higher Level of AgI

Coating Example 1C was prepared as described for Example 1B but with a bright yellow AgI level of 0.27 g/m$^2$ Ag per side.

Example 1D—Control Coating (No AgI)

Coating Example 1D was prepared like Example 1B, but with omission of bright yellow AgI from the undercoat layers.

Example 1E—Control Coating (No Undercoat)

Coating Example 1E was prepared like Example 1B, but with omission of the undercoat layers.

TABLE I

| Example No. | Percent Crossover Regular Screen | Percent Crossover Rapid Screen | Comments |
|---|---|---|---|
| 1B | 9 | 13 | Invention |
| 1C | 3 | 8 | Invention |
| 1D | 22 | 23 | Control |
| 1E | 22 | 24 | Control |

The crossover measurement results of Table I demonstrate the major reduction in crossover obtained with the use of undercoat layers containing bright yellow AgI.

Example 2—Comparison of Crossover Reduction with Bright Yellow and $\beta$ Phase AgI Undercoats Example 2A—Control Coating ($\beta$ Phase AgI Undercoat)

Coating Example 2A was prepared like Example 1B, but with a $\beta$ phase silver iodide emulsion having grains with a mean equivalent circular diameter of 0.05 $\mu$m forming an undercoat beneath the latent image forming emulsion layer. The $\beta$ phase silver iodide emulsion was prepared by a precipitation procedure generally analogous to that described below for Emulsion 1. Silver iodide coverages are set out in Table II.

Example 2B—Bright Yellow AgI Emulsion

Coating Example 2B was prepared like Coating Example 2A, but with the bright yellow silver iodide emulsion of Example 1A substituted for the $\beta$ phase silver iodide.

Example 2C—Control Coating (No Undercoat)

Coating Example 2C was prepared like Example 1B, but with omission of the undercoat layers.

Example 2D—Control Coating (No AgI)

Coating Example 2D was prepared like Example 1B, but with omission of bright yellow AgI from the undercoat layers.

Example 2E—Crossover Comparisons

Crossover was determined as described in Example 1B using Du Pont CRONEX PAR® Screens, which have a broad emission range from about 330 nm to about 600 nm, peaking at 430 nm. The results are tabulated in Table II.

TABLE II

| Example No. | Percent Crossover | AgI Type | AgI Coverage (g Ag/m$^2$/side) |
|---|---|---|---|
| 2A | 24 | $\beta$-Phase | 0.135 |
| | 23 | | 0.270 |
| | 22 | | 0.540 |
| 2B | 18 | Bright yellow | 0.135 |
| | 13 | | 0.270 |
| | 10 | | 0.540 |
| 2C* | 32 | None | 0 |

TABLE II-continued

| Example No. | Percent Crossover | AgI Type | AgI Coverage (g Ag/m²/side) |
|---|---|---|---|
| 2D** | 30 | None | 0 |

*No undercoat
**No AgI in undercoat

From Table II a significantly greater reduction in crossover was obtained with the bright yellow silver iodide emulsion employed as an undercoat as compared to the $\beta$ phase silver iodide. This demonstrates the superiority of the bright yellow silver iodide emulsions employed as undercoats for reducing crossover in combination with intensifying screens emitting in the blue portion of the visible spectrum.

Example 3—Comparison of Absorption Transition Wavelengths

Emulsion 1. $\beta$ Phase Silver Iodide (Control)

A reaction vessel equipped with a stirrer was charged with 3.0 L of water containing 80 g of deionized bone gelatin. At 35°C. the pAg was adjusted to 12.6 with KI and maintained at that value during the precipitation. The pH was recorded as 5.50 at 35° C. At 35° C. a 5.0M solution of $AgNO_3$ was added at a linearly accelerating rate (3.83× from start to finish) over a period of 42.4 min, consuming 4.0 moles Ag. A 5M solution of KI was added concurrently as required to maintain the pAg at 12.6. The pAg was then adjusted to 10.7 with $AgNO_3$. A solution of 80 g of deionized bone gelatin was added. The emulsion was washed by the ion exchange method of Maley, U.S. Pat. No. 3,782,953, and stored at approximately 4° C.

X-ray powder diffraction analysis showed the composition to be 97.7% $\beta$ phase. The average equivalent circular diameter of the grains was found to be about 0.12 μm.

Emulsion 2. $\beta$ and $\gamma$ Phase Silver Iodide (Control)

A reaction vessel equipped with a stirrer was charged with 2.5 L of water containing 40 g of bone gelatin at 35° C. The pH was adjusted to 6.00 at 35° C. using NaOH and the pAg to 2.45 with $AgNO_3$. At 35° C. a 5.0M solution of $AgNO_3$ was added at a linearly accelerating rate (2.62× from start to finish) over a period of 20.3 min, consuming 1.0 mole Ag. A 5.0M solution of KI was concurrently added as required to maintain the pAg at 2.45. The pAg was then adjusted to 10.6 with KI. A solution of 60 g of bone gelatin in 200 cc of water was then added. The emulsion was washed and stored similarly as Emulsion 1.

X-ray powder diffraction analysis showed the composition to be 72% $\beta$ and 28% $\gamma$ phase silver iodide. The greater part of the silver iodide was present as grains of an average equivalent circular diameter of 0.11 μm . A finer grain population of average equivalent circular diameter of about 0.04 μm was also present.

Emulsion 3. Bright Yellow Silver Iodide (Example)

A reaction vessel equipped with a stirrer was charged with 2.5 L of water containing 35 g of deionized bone gelatin. At 35° C. the pH was adjusted to 5.0 with $H_2SO_4$, and the pAg to 3.5 with $AgNO_3$. At 35° C. a 1.25M solution of $AgNO_3$ was added at a constant rate over 6 min, consuming 0.0038 mole Ag. The flow of $AgNO_3$ was then accelerated following the profile approximated by the equation flow rate=Initial Rate+0.023t+0.00134t² (t=time of acceleration in min) over a period of 44 min, consuming 0.089 mole Ag. Flow was continued at a constant rate over a period of 70 min, consuming 0.312 mole Ag. This was followed by acceleration on the same profile as previously over 26 min, consuming 0.176 mole Ag. Finally a constant flow over 45 min consumed 0.424 mole Ag. A total of 1.0 mole Ag was consumed in the precipitation. Concurrently with the $AgNO_3$, a 1.25M solution of NaI was added as required to maintain the pAg at 3.36. A 25% deionized bone gel solution containing 50 g of gelatin was added. The pAg was adjusted to 10.1 with KI and the pH to 4.00 with $H_2SO_4$. A 1 L portion of the emulsion was washed as described for Emulsion 1, 17 g of gelatin (25% solution) added, and the pH adjusted to 4.00. The emulsion was stored at approximately 4° C.

X-ray powder diffraction analysis showed some of characteristics to match those of $\alpha$ phase silver iodide, but significant differences from $\alpha$ phase, $\beta$ phase, and $\gamma$ phase silver iodide prevented positive assignment of any art recognized silver iodide crystalline class. Unlike Emulsions 1 and 2, which were pale yellow, Emulsion 3 was bright yellow at room temperature. The grains exhibited an average equivalent circular diameter of 0.09 μm.

ABSORPTION SPECTRA

For measurement of the absorption spectra, coatings of each emulsion were made on an acetate support at 0.86 g/m² Ag, 9.77 g/m² gelatin. The coating melts were adjusted to pAg 5.0 at 35° C. using $AgNO_3$ or NaI as required, and to pH 4.00 at 35° C., using $H_2SO_4$ or NaOH as required. A sample of Emulsion 3 was coated on the same day it was precipitated. Another sample was coated one week after precipitation, and still another sample was coated four weeks after precipitation. Between precipitation and coating Emulsion 3 was held at 4° C. Spectra were measured using a DIANO MATCHSCAN® spectrophotometer. From curves plotting percent absorption versus wavelength, it was determined that the absorption transition wavelength was in each instance 490 nm—that is, invariant as a function of the delays in coating. When the transition wavelength of a coating held for four weeks at room temperature was compared with the transition wavelength of a fresh coating, the transition wavelengths of the two coatings were identical. This showed that the silver iodide was in a stable state.

Absorption spectra were obtained using Emulsions 1 and 2 similarly as described above. In each instance Emulsion 1 showed an invariant transition wavelength of 455 nm, and Emulsion 2 showed an invariant transition wavelength of 465 nm. Although Emulsion 2 exhibited a 10 nm bathochromic displacement of the transition wavelength as compared to Emulsion 1, this absorption difference was not sustained at wavelengths shorter than the transition wavelength. At wavelengths shorter than its transition wavelength Emulsion 2 approached the absorption of Emulsion 1, exhibiting essentially the same absorption at a wavelength of 420 nm.

RELATED ART APPENDIX

Additional art related to silver iodide is listed in chronological order of publication:

1. Steigmann German Pat. No. 505,012, issued Aug. 12, 1930.

2. Steigmann, Photographische Industrie, "Green and Brown Developing Emulsions", Vol. 34, pp. 764, 766, and 872, published July 8 and Aug. 5, 1938.

Items 1 and 2 disclose the preparation of silver halide emulsions having a green tint by introducing sodium chloride into a silver iodide emulsion.

3. Carroll U.S. Pat. No. 2,327,764, issued Aug. 24, 1943, discloses the use of silver iodide as an overcoat acting as an ultra-violet filter.

4. Zharkov, Dobroserdova, and Panfilova, "Crystallization of Silver Halides in Photographic Emulsions IV. Study by Electron Microscopy of Silver Iodide Emulsions", *Zh. Nauch. Prikl. Fot. Kine,* March–April, 1957, 2, pp. 102–105.

5. Ozaki and Hachisu, "Photophoresis and Photoagglomeration of Plate-like Silver Iodide Particles", *Science of Light,* Vol. 19, No. 2, 1970, pp. 59–71.

Items 4 and 5 report silver iodide precipitations with an excess of iodide ions, producing hexagonal crystal structures of predominantly $\beta$ phase silver iodide.

6. James, *The Theory of the Photographic Process,* 4th Ed., Macmillan, 1977, pp. 1 and 2, contains the following summary of the knowledge of the art:

> According to the conclusions of Kokmeijer and Van Hengel, which have been widely accepted, more nearly cubic AgI is precipitated when silver ions are in excess and more nearly hexagonal AgI when iodide ions are in excess. More recent measurements indicate that the presence or absence of gelatin and the rate of addition of the reactants have pronounced effects on the amounts of cubic and hexagonal AgI. Entirely hexagonal material was produced only when gelatin was present and the solutions were added slowly without an excess of either $Ag^+$ or $I^-$. No condition was found where only cubic material was observed.

7. Maskasky, *Research Disclosure,* Item 16158, Vol. 161, pp. 84–87, September 1977, discloses the preparation of monodisperse hexagonal bipyramid silver iodide crystals by a double jet precipitation technique which utilized accelerated reactant introduction rates.

8. Daubendiek, "AgI Precipitations: Effects of pAg on Crystal Growth(PB)", II-23, *Papers from the* 1978 *International Congress of Photographic Science,* Rochester, N.Y., pp. 140–143, 1978, reports the double jet precipitation of silver iodide under a variety of conditions. Spectral absorption and X-ray diffraction measurements reportedly gave no indication of $\alpha$ phase silver iodide in the precipitated emulsions examined.

9. Maskasky U.S. Pat. No. 4,094,684, issued June 18, 1978, discloses silver chloride epitaxially deposited on silver iodide grains.

10. Maskasky U.S. Pat. No. 4,142,900, issued Mar. 6. 1979, discloses conversion of silver chloride epitaxially deposited on silver iodide grains using bromide ions.

11. Maskasky *Research Disclosure,* Vol. 181, May 1979, Item 18153, reports silver iodide phosphate photographic emulsions in which silver is coprecipitated with iodide and phosphate.

12. Maskasky U.S. Pat. No. 4,158,565, issued June 19, 1979, discloses the use of grains containing silver chloride epitaxially deposited on silver iodide grains in a dye image amplification process.

13. Koitabashi U.K. Specification No. 2,063,499A, published Feb. 4, 1981, discloses silver bromide or bromoiodide epitaxially deposited on silver iodide host grains.

14. Maskasky U.S. Pat. No. 4,459,353, issued July 10, 1984, discloses high aspect ratio tabular grain $\gamma$ phase silver iodide emulsions.

5. House U.S. Pat. No. 4,490,458, issued Dec. 25, 1984, discloses tabular grain silver iodide emulsions employed in multicolor photographic elements.

The invention has been described in detail with particular reference to preferred embodiments thereof, but it will be understood that variations and modifications can be effected within the spirit and scope of the invention.

What is claimed is:

1. A radiographic element comprised of a support capable of transmitting blue light, coated on each of two opposite major faces of said support, a silver halide emulsion layer capable of forming a latent image in response to exposure to blue light transmitted through the support, and interposed between at least one of said latent image forming emulsion layers and said support a blue absorbing layer, characterized in that said blue absorbing interposed layer is a silver iodide emulsion layer exhibiting at temperatures below 25° C. an absorption transition wavelength that is bathochromically displaced by at least 20 nm as compared to the absorption transition wavelength of $\beta$ phase silver iodide.

2. A radiographic element according to claim 1 in which the support is transparent.

3. A radiographic element according to claim 2 in which the support is blue.

4. A radiographic element according to claim 1 in which at least one of said emulsion layers for forming a latent image is a tabular grain silver halide emulsion layer in which tabular grains having a thickness of less than 0.5 $\mu$m and an aspect ratio of greater than 5:1 account for at least 50 percent of the total grain projected area.

5. A radiographic element according to claim 4 in which at least one of said emulsion layers for forming a latent image is a tabular grain silver halide emulsion layer in which tabular grains having a thickness of less than 0.3 $\mu$m and an aspect ratio of greater than 8:1 account for at least 50 percent of the total grain projected area.

6. A radiographic element according to claim 4 in which at least one of said emulsion layers for forming a latent image is a tabular grain silver halide emulsion layer in which tabular grains having a thickness of less than 0.2 $\mu$m and an aspect ratio of greater than 5:1 account for at least 50 percent of the total grain projected area.

7. A radiographic element according to claim 4 in which a blue spectral sensitizing dye is present in said tabular grain emulsion layer.

8. A radiographic element according to claim 1 in which said silver iodide emulsion layer exhibits at temperatures below 25° C. an absorption transition wavelength that is bathochromically displaced by at least 30 nm as compared to the absorption transition wavelength of $\beta$ phase silver iodide.

* * * * *